United States Patent [19]

Hart

[11] Patent Number: 4,945,737

[45] Date of Patent: Aug. 7, 1990

[54] LOCKSET ASSEMBLY

[75] Inventor: Leroy Hart, Farmington, Conn.

[73] Assignee: Emhart Industries, Inc., Towson, Md.

[21] Appl. No.: 799,555

[22] Filed: Nov. 19, 1985

Related U.S. Application Data

[63] Continuation of Ser. No. 6/568,542, Jan. 5, 1984, abandoned, which is a continuation-in-part of Ser. No. 6/537,896, Sep. 30, 1983, Pat. No. 4,594,864.

[51] Int. Cl.[5] ..... E05B 55/06

[52] U.S. Cl. ..... 70/143; 70/474; 70/479; 70/489; 292/167; 292/169.15

[58] Field of Search ..... 70/129, 143, 145, 151 A, 70/463, 464, 471, 472, 474–485, 489; 292/139, 167, 169.13–169.19, 337, 357, DIG. 38, DIG. 56, DIG. 73

[56] References Cited

U.S. PATENT DOCUMENTS

| | | | |
|---|---|---|---|
| 71,944 | 12/1867 | Andrews | 292/169.13 X |
| 1,137,800 | 5/1915 | Shaw | 292/169.15 |
| 2,661,972 | 12/1953 | Schlage | 292/169.13 X |
| 3,390,558 | 7/1968 | Tornoe et al. | 70/145 |
| 3,751,085 | 8/1973 | Sanders et al. | 292/169.15 X |
| 4,031,725 | 6/1977 | Reid | 70/432 X |
| 4,248,452 | 2/1981 | Allenbaugh | 292/167 |
| 4,333,324 | 6/1982 | Dietrich et al. | 70/143 X |
| 4,422,677 | 12/1983 | Gater | 292/167 |
| 4,593,542 | 6/1986 | Rotondi et al. | 292/139 X |
| 4,594,864 | 6/1986 | Hart | 70/143 |
| 4,643,007 | 2/1987 | Fish et al. | 70/474 X |
| 4,656,849 | 4/1987 | Rotondi et al. | 292/139 X |
| 4,725,085 | 2/1988 | Hu et al. | 70/129 X |

*Primary Examiner*—Robert L. Wolfe
*Assistant Examiner*—Suzanne L. Dino
*Attorney, Agent, or Firm*—Barry E. Deutsch; J. Bruce Hoofnagle

[57] ABSTRACT

A lockset for a door comprising a latch bolt assembly including a bolt movable between a partially extended latching position, a fully extending dead bolt position, and a retracted position. A spring biases the bolt toward its dead bolt position and a spindle extends through the latch assembly. The spindle is connected to the bolt to move the bolt between its positions upon rotation of the spindle. A mechanism is provided for holding the latch bolt in its latching position when the door is open and a mechanism responsive to the closing of the door is provided to move the latch bolt automatically into its dead bolt position.

12 Claims, 4 Drawing Sheets

LOCKSET ASSEMBLY

CROSS-REFERENCE TO RELATED APPLICATION

This application is a continuation of U.S. Patent Application Ser. No. 568,542 now abandoned, which is a continuation-in-part of my copending U.S. Patent Application Ser. No. 537,896 filed Sept. 30, 1983 and entitled Lockset Assembly, now U.S. Pat. No. 4,594,864.

BACKGROUND OF THE INVENTION

This invention relates in general to a lockset and more particularly to a lockset assembly in which the latch bolt is extendable into a dead bolt function.

In my copending U.S. Patent Application Ser. No. 537,896 filed Sept. 30, 1983 entitled Lockset Assembly, the disclosure of which is incorporated herein by reference in its entirety, there is disclosed a lockset in which the latch bolt is extendable from a latching position into a fully extended dead bolt position. According to the function shown in that application, the latch bolt is extendable into its dead bolt position either by a key operated cylinder on the outside operating member or a turn button on the inside operating member. The inside operating member can always retract the latch bolt whether in the latching position or dead bolt position. However, it is possible to adopt the basic mechanism shown in that application for other functions.

SUMMARY OF THE INVENTION

It is an object of the present invention to provide an improved lockset assembly which functions both as a latch bolt and a dead bolt.

More specifically, it is an object of the present invention to provide a lockset assembly in which the latch bolt is automatically extendable into a dead bolt position when the door is closed.

Yet another object of the present invention is to provide a lockset assembly in which the latch bolt is automatically extendable into a dead bolt position when the door is closed and will remain in the latching position when the door is open.

A further object of the present invention is the provision of a lockset assembly in which when an operating member is in the "lock" position, the latch bolt will move into its dead bolt position automatically when the door is closed, and when the operating member is in the "unlock" position, the latch bolt will remain in the latching position after the door is closed.

Yet another object of the present invention is the provision of a lockset utilizing a latch assembly having a latch bolt movable into an extended dead bolt position and including means for maintaining the latch bolt in its intermediate latching position.

These and other objects of the present invention may be accomplished by the provision of the lockset to be described below.

DETAILED DESCRIPTION

Figure 1:
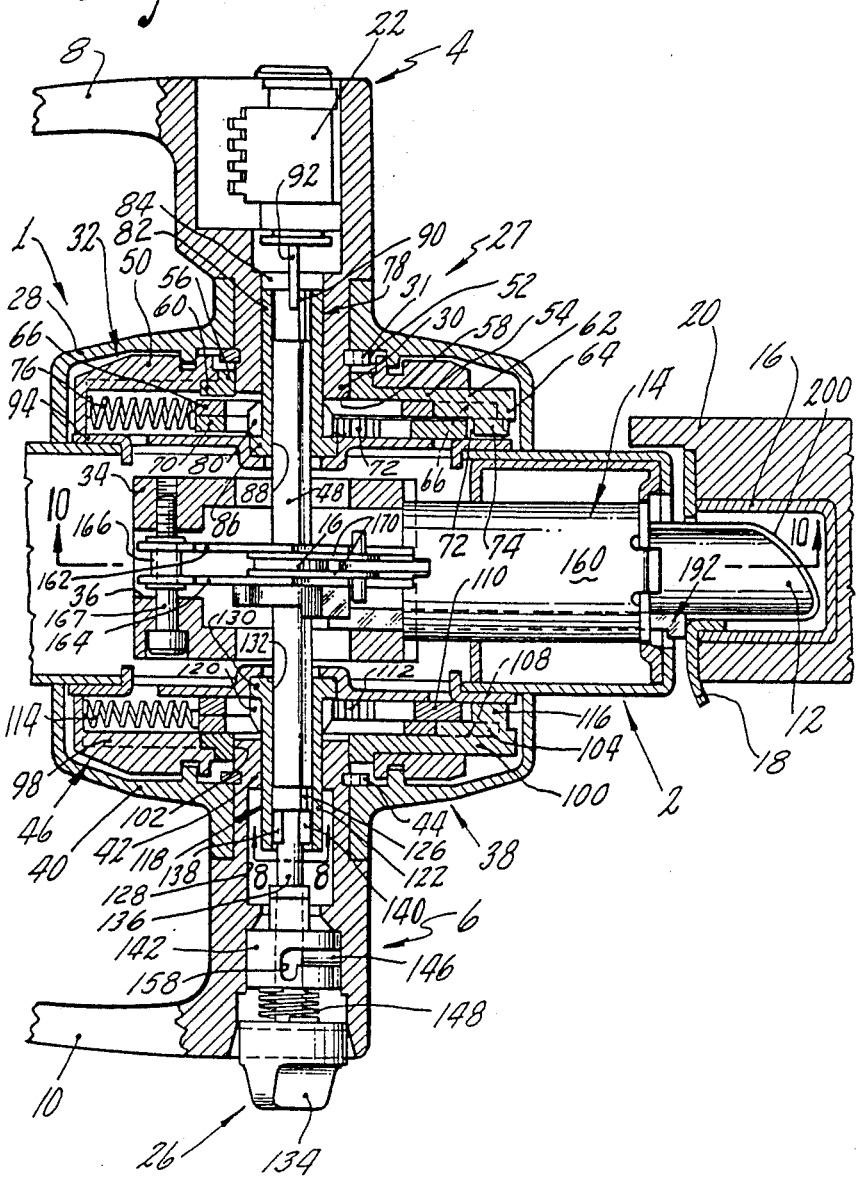
FIG. 1 is a horizontal sectional view taken along the horizontal axis of the lockset showing the lockset mounted within a metal door frame and the latch bolt in its dead bolt or fully extended position.

The basic construction of the lockset of this invention is described in detail in the abovementioned copending application Ser. No. 537,896 and reference should be made thereto for a detailed description. Generally, according to the drawings and in particular FIG. 1 of this application, the lockset mechanism 1 of the present invention is shown mounted in a metal door 2 and includes an outside hand operated member 4 and an inside hand operated member 6 which in the preferred embodiment are an outside lever 8 and an inside lever 10. The outside and inside levers 8 and 10 are used to retract a latch bolt 12 of the latch bolt assembly 14 of the lockset mechanism from a strike box 16 and strike plate 18 mounted on the door jamb 20 in conventional fashion. The outside operating assembly 27 of the lockset may be provided with a key operated lock cylinder 22 mounted within the outside lever 8 and the inside operating assembly 38 of the lockset may be provided with a turn button 26 mounted within the inside lever 10.

The outside operating assembly 27 includes the outside lever 8 which is rotatably mounted within an outside rose 28 and includes a generally square-shaped projection 30 extending into the outside rose 28 and is held in place for rotational motion with respect thereto by a retaining ring 31. Positioned within the outside rose 28 is an outside operating cassette 32 having upper and lower ear-like projections (not shown) which extend therefrom and which fit into suitable grooves (not shown) on the outer surface of a latch bolt assembly holder 34 which is positioned within the door 2. The latch bolt assembly holder 34 provides a mechanism for mounting the latch bolt assembly 14 which contains the latch bolt 12 and includes a suitable slot 36 into which the latch bolt assembly 14 may be inserted.

In a similar manner, an inside operating assembly 38 includes the inside lever 10 which is pivotally mounted within an inside rose 40 and includes a generally square-shaped projection 42 extending thereinto and which has a retaining ring 44 attached thereto so that the inside lever 10 is mounted for relative rotation with respect to the inside rose 40 in a like manner as the outside operating assembly 27. An inside operating cassette 46 is mounted within the inside rose 40 and includes upper and lower ear-like projections (not shown) which extend into grooves (not shown) on the latch bolt assembly holder 34. A spindle 48 extends through the latch bolt assembly 14 and between the inside and outside operating cassettes 27 and 38 in a direction perpendicular to the axis of movement of the latch bolt 12. The lockset may be assembled in the door as described in the above-mentioned Patent Application Ser. No. 537,896.

The outside operating cassette 32 includes a housing 50 which has a central opening 52 into which the projection 30 of the outside lever 8 extends. An actuating member 54 is mounted in the outside operating cassette 32 with a boss 56 thereof mounted in the opening 52 in the housing 50 and includes a generally squared-shaped opening 58 into which extends the generally square-shaped projection 30 of the outside lever 8. The actuating member 54 includes a base portion 60 and a reduced elongated tail portion 62 which extends from the base portion 60. The forward end of the tail portion 62 is provided with a raised V-shaped cam surface 64 extending inwardly past the plane of the inner surface of the tail portion 62.

A spring plate 66 is mounted within the housing 50 of the outside operating cassette 32 in overlapping relationship with the actuating member 54. At its forward end the spring plate 66 includes two spaced fingers 68 (only one of which is shown), each having a cam follower surface thereon adapted to be engaged by the V-shaped cam surface 64 on the actuating member 54. The spring plate 66 is biased forwardly in the direction of extension of the latch bolt 14 into engagement with the cam surface 64 on the actuating member 54 by means of two lever springs (not shown).

A generally flat rack plate 70 is mounted within the housing 84 in overlapping relationship with the spring plate 66. Gear teeth 72 are provided on the rack plate 70 forming a rack thereon which extends parallel to axis of the latch bolt assembly 14. The forward end of the rack plate 70 is provided with a notch 72 into which extends a lug portion 74 extending inwardly from the forward end of the actuating member 54 when the rack plate 70 is in its forward position to prevent rotation of the actuating member 54. The rack plate 70 is biased into its forward position by a spring member 76. The rack plate 70 and spring plate 66 are mounted in the housing 50 for linear movement in the direction of the movement of the latch bolt 12 and are so configured that rearward movement of the spring plate 66 causes the rack plate 70 to move rearward as more fully described in the above-mentioned U.S. patent application.

A pinion member 78 extends perpendicular to the axis of the latch bolt assembly 14 and is mounted within the outer operating cassette 32 and includes a set of gear teeth 80 which are in mating engagement with the gear teeth 72 on the rack plate 70. The pinion member 78 also includes a tubular extension portion 82 which extends through the spring plate 66, actuating member 54, and housing 50 into an opening 84 in the outside lever 8.

The head portion 86 of the pinion member 78 has a generally rectangular slot 88 therein of a mating cross-section with that of the spindle 48 which extends therethrough. The tubular extension portion 82 includes internal opposed ribs 90 therein (only one of which is shown) which are engagable by a drive member 92 connected to the lock cylinder 22 in the outside lever 8 to rotate the pinion member 78 from its extended dead bolt position to its retracted position or the latch bolt position depending upon how far the key is turned.

In accordance with the above described arrangement and again as described in the abovementioned patent application, the actuating member 54 has pivotable movement about the axis of the spindle 48 and is operably attached to the outside lever 8. The spring plate 66 and rack plate 70 are mounted within the housing 50 for rectilinear motion in a direction parallel to the motion of the latch bolt 12 of the latch bolt assembly 14.

A cover member 94 is provided for the outside operating cassette 32 to contain the operative parts within the outside cassette 32 as a unit.

The inside operating assembly 38 includes the inside rose 40 and the inside lever 10 attached thereto in a similar manner as the outside operating assembly 27 by a retaining ring 96. The inside operating cassette 46 includes basically the same elements and is constructed similar to that of the outside operating cassette 32 which has been described above.

In general inside operating cassette 46 includes an inside housing 98 in which is mounted for pivotal movement an inside actuating member 100. The inside actuating member 100 includes a central generally square-shaped opening 102 into which the square-shaped projection 42 of the inside lever 10 projects as well as a raised V-shaped cam portion 104. A spring plate 106 having cam surfaces 108 (only one of which is shown) for engagement with the cam portion 104 on the actuating member 100 is mounted in the inside housing 98. As in the case of the outside operating mechanism, the spring plate 106 is spring biased forwardly by suitable spring members (not shown).

A rack plate 110 having gear teeth 112 is mounted in the inside housing 98 in overlapping relationship with the spring plate 106. The rack plate 110 may be spring biased forwardly by a spring member 114 although this spring may be omitted. However, in contrast to the rack plate 70 of the outside operating assembly 27, the forward end of the rack plate 110 of the inside operating assembly 38 is foreshortened and does not include a notch so that when it is in its forward dead bolt position as shown in FIG. 1 the forward end thereof does not come into engagement with the lug portion 116 on the actuating member 100. As a result, the actuating member 100 is free to pivot when the rack plate 110 is in its forward dead bolt position.

An inside pinion member 118 includes gear teeth 120 thereon in mating engagement with the teeth 112 on the rack plate 110. The pinion member 118 includes a tubular extension 122 having opposed ribs 124, 126 therein which extends through the inside operating cassette 46 into an opening 128 in the inside lever 10. The head portion 130 of the pinion member 118 also includes a slot 132 through which one end of the spindle 48 extends. A cover 133 is attached to the housing 98 to contain the operating mechanisms.

Figure 7:
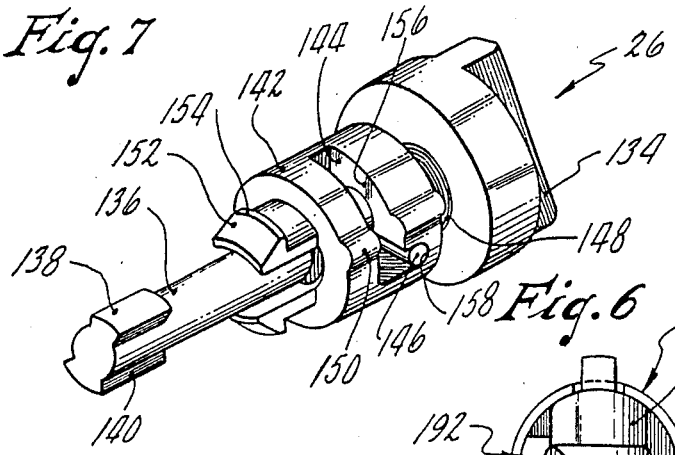
FIG. 7 is a perspective view of the thumb piece assembly used in connection with the inside operating member of the lockset.
Figure 6:
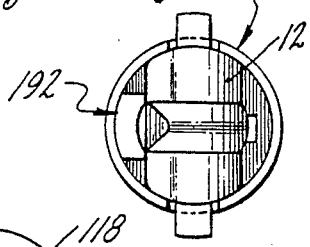
FIG. 6 is an end view of the latch assembly taken along the lines 6—6 of FIG. 2.
Figure 8:
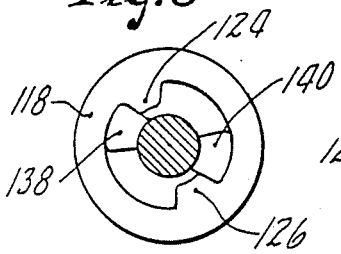
FIG. 8 is a view taken along the lines 8—8 of FIG. 1 and showing the relationship of the turn button actuator with respect to the pinion extension when the turn button is in the locked position.

Referring to FIGS. 1 and 7, the turn button 26 includes a knob 134 having a rod 136 extending inwardly therefrom. The end of the rod 136 includes two opposed radial extending ear portions 138 and 140 for engaging the opposed ribs 124 and 126 in the tubular extension 122 of the inside pinion member 118. The rod 136 extends through and has relative rotation with a cam member 142 which has a cam slot 144 therein. A cam follower 146 in the form of a roll pin extends radially out from the rod 136 into the cam slot 144. A spring 148 is provided between the cam member 142 and the knob 144 to bias the knob 144 outwardly.

The cam member 142 includes a bump 150 on its circumference which mates with an indentation (not shown) in the opening 128 in the inside lever 10 to prevent rotation of the cam member 142 with respect to the lever 10. The cam member 142 also includes inwardly projecting tongues 152 having shoulders 154 thereon for retaining the cam member 142 within the inside lever 10. When mounted in the lever 10, the rod 136 extends into the pinion member 118 of the inside operating assembly.

The cam slot 144 extends partially around the circumference of the body of the cam member 142 and includes a generally straight portion 156 and an axially extending locking groove 158 which forms a stop shoulder for the cam follower 146. When the knob 144 is rotated from its locked position wherein the cam follower 146 is in the straight portion 156 of the cam slot 144 to its unlocked position, the cam follower 146 will reach the axially extending locking groove 158. At this point, the knob 144 and rod 136 will move outwardly under the force of the spring 148, whereby the stop shoulder will prevent relative rotation of the rod 136 and cam member 142 holding the knob 134 in the unlocked position until the knob 144 is manually pushed inwardly and rotated.

Figure 2:
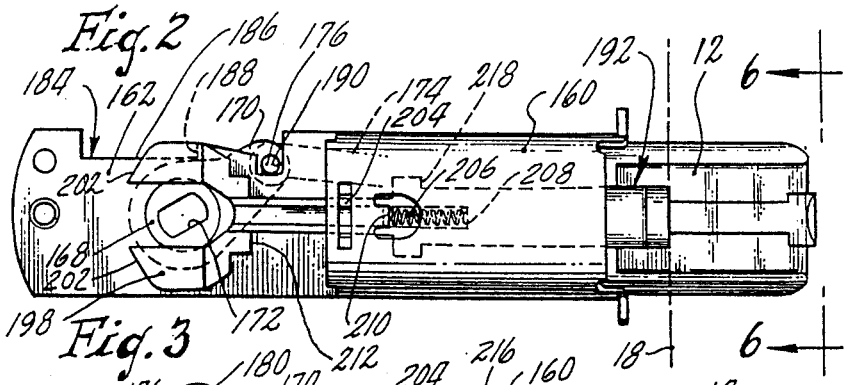
FIG. 2 is a side view in elevation of the latch bolt assembly with the latch bolt in its dead bolt or fully extended position.
Figure 3:
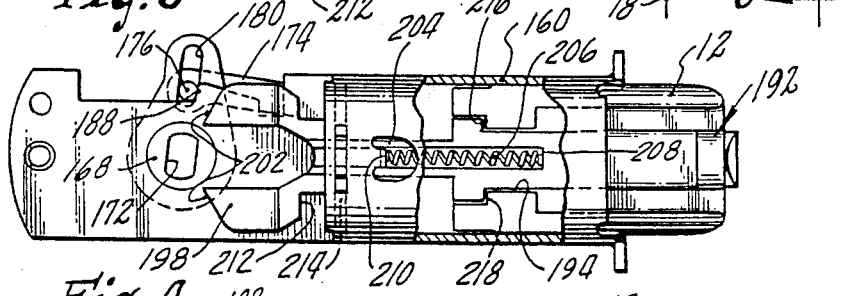
FIG. 3 is a view similar to that of FIG. 2 but showing the latch bolt in its latching position.
Figure 4:
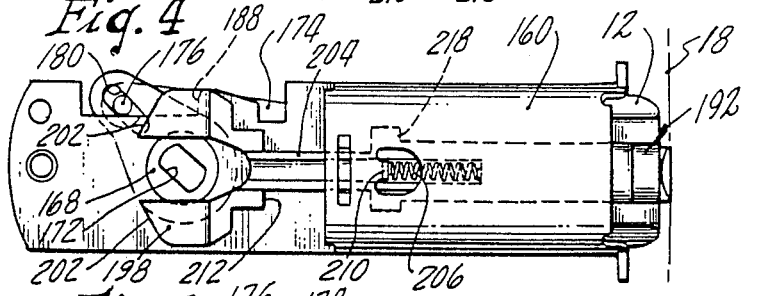
FIG. 4 is a view similar to that of FIG. 2 but showing the latch bolt in its open or fully retracted position.

Referring to FIGS. 2–5 and 10, the latch bolt 12 of the latch bolt assembly 14 is shown movable between its extended dead bolt position in FIG. 2, its intermediate latching position in FIG. 3 and its fully retracted open position in FIG. 4. The latch bolt assembly 14 includes a latch case 160 having two spaced latch plates 162 and 164 (FIG. 1) extending rearwardly therefrom. The latch plates 162 and 164 are held mounted together by means of bushings 166. The latch bolt assembly 14 is mounted within the slot 36 in the latch bolt assembly holder 34 with the screw 167 which attaches the latch bolt assembly 14 to the latch bolt assembly holder 38 extending through the rearward one of the bushings 166.

A hub member 168 upon which two lever plates 170 are mounted for rotation therewith is mounted between the two latch plates 162 and 164 in suitable openings therein. The hub member 168 has a generally rectangular bore 172 therethrough of a shape to receive the spindle 48. The bolt 12 is mounted within the latch case 160 and has an arm 174 (FIG. 10) extending rearwardly therefrom toward the lever plates 170. The arm 174 is pivotably attached at its forward end to the bolt 12 and at its rearward end has a pivot pin 176 extending through an elongated slot 178 in each of the lever plates 170. A guide 180 having opposed side walls in which the arm 174 is positioned is also pivotally attached to the rearward end of the bolt 12.

As described in the above-mentioned U.S. patent application, a spring biased dowel 182 is mounted in the bolt 12 and has its end face engaging one corner on the forward portion of the arm 174. This serves to bias the arm 174 in a direction such that the pivot pin 176 will engage the upper edges 184 of the latch plates 162 and 164.

The upper edges 184 of the latch plates 162 and 164 include a rearward cutout portion 186 forming rearward facing stop shoulders 188 which is engagable by the pin 176 to stop the latch bolt 12 in its latching position. Forward of the cutout portion 186 the upper edges slope downwardly toward another cutout portion which forms a notch 190 to releasably retain the bolt 12 in the extended, dead bolt position. A spring 191 extends between the side plates 162 and 164 and the latch bolt 12 to bias the bolt 12 toward its forward, dead bolt position.

A latch release plunger 192 is mounted in a slot 194 in the bolt and has a forwardly extending strike abutting portion 196 extending forwardly out of the latch case 160 and cam portion 198 extending rearward from the case 160. The latch release plunger 192 is positioned on the side of the bolt 12 opposite the bevel 200. The cam portion 198 is forked and includes upper and lower rearward facing cam surfaces 202. An intermediate portion 204 of the latch release plunger 192 is channel-shaped in which a spring 206 is mounted between a shoulder 208 and an inturned projection 210 on the latch case 160 to bias the latch release plunger 192 into its forward position. When the latch release plunger 192 is biased into its forward position, the forward face 212 of the cam portion 198 abuts the rearwall 214 (FIG. 3) of the latch case 160. In this position, the strike abutting portion 196 extends outwardly adjacent the end of the bolt 122.

A pair of rearward facing shoulders 216 on the bolt 12 are adapted to engage a pair of forwardly facing shoulders 218 on the latch release plunger so that upon inwardly movement of the bolt 12 when it is being retracted from its latching position to its open position, it will move the latch release plunger 192 inwardly into its open position as seen in FIG. 4. When the latch release plunger 192 is in its open position, the rearward facing cam surfaces 202 are rearward of the stop shoulder 188 on the latch plate 162.

Figure 5:
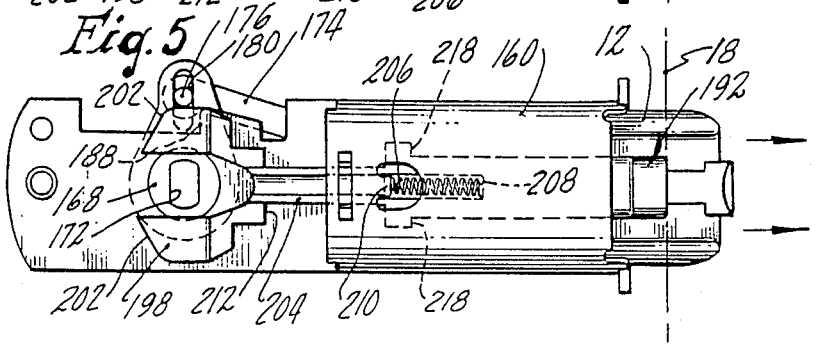
FIG. 5 is a view similar to that of FIG. 2, but showing a bolt moving forward to its extended position after the door has been closed.
Figure 9:
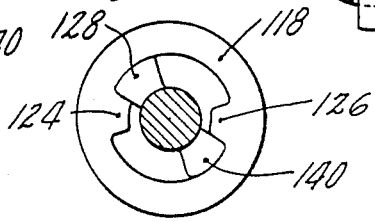
FIG. 9 is a view similar to FIG. 8 but showing the relative position of the turn button actuator with respect to the pinion extension when the turn button is in the unlocked position.
Figure 10:
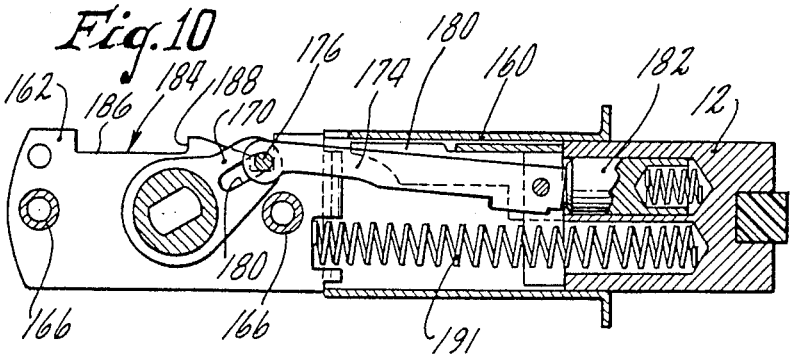
FIG. 10 is a cross-sectional view of the latch assembly taken along the lines 10—10 of FIG. 1.

The operation of the operating elements of the inside and outside cassettes are substantially the same as described in the above said patent application Ser. No. 537,896. Accordingly, the operations of such elements will not be described in detail except as needed for and understanding of the present invention. When the door is closed, and the turn button 26 is in its locking position, i.e. with the cam follower 146 in the straight portion 156 of the cam slot 144, the latch bolt 12 will be in its extended dead bolt position as shown in FIG. 2 and the latch release plunger 192 will be held in its rearward open position by the strike 18. In this position, the outside lever 8 cannot be rotated since the rack plate 70 is in its forward position and that the lug portion 74 on the actuating member 54 is positioned in the notch 72 thereof. This arrangement prevents the outside lever 8 from being turned since the actuating member 54 attached thereto cannot be rotated. As there is no notch in the rack plate 110 of the inside operating assembly 38, the inside lever 10 is free to rotate. Upon rotation of the inside lever 10, the actuating member 100 pivots about the axis of the spindle 48 and the cam portion 104 thereof engages the cam surfaces 108 on the ends of the spring plate 106 causing the spring plate 108 to move rearwardly in a linear direction. Due to the engagement of the spring plate 108 with the rack plate 110, the rack plate 110 also moves rearwardly in a linear direction causing the pinion member 118 to rotate thereby rotating the spindle 48 and the hub member 168 of the latch bolt assembly 14 causing the complete retraction of the latch bolt 12 into the position substantially as shown in FIG. 4. When the door is opened and the operator releases the inside lever 10, the latch bolt 12 and latch release plunger 192 Will move forward under the influence of their respective springs. The latch bolt 12 will move forward until the pivot pin 176 engages the stop shoulder 188 in the upper edges of the latch plates 162 and 164 thereby holding the latch bolt 12 in its latching position. As the door is closed and moves past the strike 18, the latch bolt 12 and latch release plunger 192 are moved into their open position by the strike 18 as shown in FIG. 4. In this position, the pivot pin 176 is rearward of the cam surfaces 202 of the latch release plunger 192. When the door is completely closed, the latch bolt 12 moves forwardly under the influence of the latch spring 191 into the strike box 16 while the latch release plunger 192 is held in its rearward open position by the strike 18 as shown in FIG. 5. As the bolt 12 moves forward into its dead bolt position, the cam surfaces 202 on the latch release plunger 192 cause the pivot pin 176 to move upwardly over the stop shoulder 188 on the upper edges 184 of the latch plates 162 and 164 enabling the pivot pin 176 to continue forward until it engages the forward pin receiving notch 190 in which position the latch bolt 12 is in its fully extended dead bolt position. When the turn button 26 is moved into its unlocked position, i.e. the cam follower 146 is positioned in the locking groove 158 in the cam slot 144, due to the interconnection between the ear 138 and 140 portions on the rod 136 of the turn button 26 and the ribs 124 and 126 in the extension portion of the pinion member 118, the inside pinion member 118 will be rotated thereby rotating the spindle 148 to rotate the hub 168 of the latch assembly 14 into its latching position thereby retracting the latch bolt 12 into its latching position. In this position, the pinion member 118 and ears 138 and 140 on the rod 136 of the turn button 26 will be positioned as shown in FIG. 9 so that rotation of the pinion member 118 in a counterclockwise direction is prevented by the ribs 124 and 126 engaging the ears 138 and 140 on the rod 136 of the turn button. Since the cam follower 146 must be manually released from the locking groove 158 in the cam slot 144 by depressing the knob 134 and turning, the latch bolt 12 will be held in its intermediate position even if the latch release plunger 192 is moved rearwardly as by closing the door. Thus, the latch bolt 12 only moves forwardly from its open position to its latching position when the turn button 26 is in its unlocked position.

When the latch bolt 12 is in its intermediate or latching position, the outside rack plate 70 is held in its intermediate position wherein the notch 72 is out of engagement with the lug portion 74 on the actuating member 54. Accordingly, the actuating member 54 is free to rotate whereby the outside lever 8 can be rotated to move the latch bolt 12 from its latching position to its open position to open the door.

The lock cylinder 22, by virtue of its drive member 92 engaging the ribs 90 of the outside pinion member 92, can be used to open the door when the door is locked with the latch bolt 12 in its fully extended dead bolt position. However, the cylinder 22 and key cannot be used to change the function from either locked to unlocked or from unlocked to locked.

Figure 11:
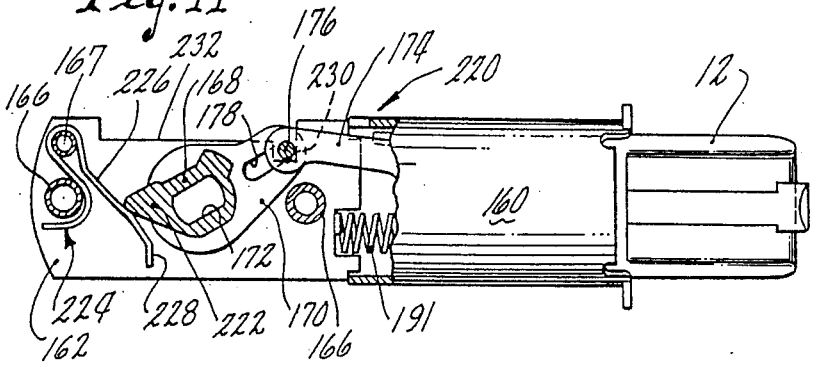
FIG. 11 is an elevational view, partially in section of a modified form of a latch assembly for different function and showing the latch bolt in its extended dead bolt position.
Figure 12:
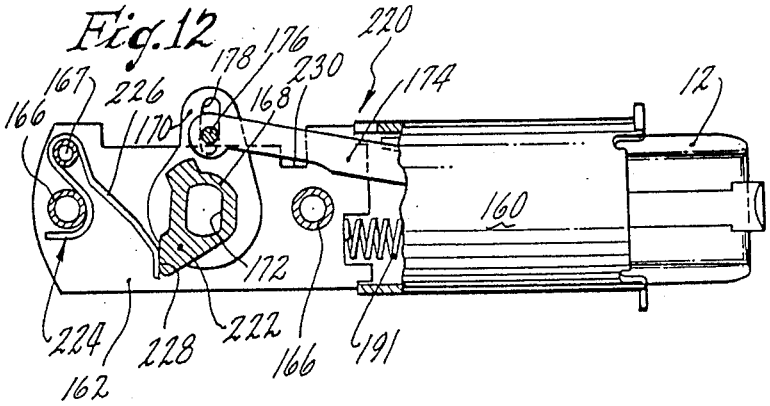
FIG. 12 is a view similar to FIG. 11, but showing the latch bolt in its intermediate latching position.

FIGS. 11 and 12 show a modified form of a latch bolt assembly 220 which may be used when both the outside and inside operating members 4 and 6 utilize a key operated cylinder member with a drive member extending therefrom into their respective inside and outside pinion to engage the ribs. The latch bolt assembly generally similar to that described in connection with FIGS. 2–5 and 10, and includes a latch case 160 having two spaced latch plates 162 extending rearwardly therefrom (only one of which is shown). The latch plates 162 are held mounted together by means of bushings 166. A hub member 168 on which two lever plates 170 (only one of which is shown) are mounted for rotation therewith, is mounted between the two latch plates in suitable openings therein. The hub member 168 has a generally rectangular bore 172 therethrough of a shape to receive the spindle 48. The bolt 12 is mounted with the latch case 160 and has an arm 174 extending rearwardly therefrom toward the lever plates 170. An arm 174 is pivotally attached at its forward end and the bolt 12 as its rearward end has a pivot pin 176 extending through elongated slots 178 in each of the lever plates 170. A spring biased dowel such as shown in the previous embodiment may be mounted in the bolt 12 and a bolt spring 191 extends between the side plates and the latch bolt 12 to bias the bolt 12 toward its forward dead bolt position. In this case, the hub 168 includes a generally V-shaped tab portion 222. A spring member 224 has an end portion wrapped partially around the rear bushing 166 with an intermediate portion wrapped around the screw 167 which attaches the latch bolt assembly 14 to the latch bolt assembly holder 38. The spring also includes a forwardly and downwardly extending intermediate portion 226 and a forward end portion 228 which extends generally vertical as shown in FIG. 11.

When the latch bolt is in its fully extended dead bolt position, the tail on the hub engages the intermediate portion 226 of the spring 224 to bias the latch bolt into its forward position wherein the pivot pin is positioned within a notch 230 in the forward end of the cut out portion 232 on the upper edges of the latch plates 162. When the latch bolt 12 is moved into its intermediate latching position, the tail piece engages the generally vertical portion 228 of a spring which biases the hub 222 against rotation in a clockwise direction into the forward position thereby holding the latch bolt in its intermediate latching position. In this embodiment, the key operated cylinders in either the inside or outside member can be used to retract the dead bolt from its extended position into the intermediate position and also can be used to move the hub member against the bias of the spring to move the dead bolt from its intermediate position into its locked position.

While reference has been made above to specific embodiments it will be apparent to those skilled in the art that various modifications and alterations may be made thereto without departing from the spirit of the present invention. Therefore, it is intended that the scope of this invention be ascertained by reference to the following claims.

What is claimed is:

1. A lockset having unlocked and locked states for a door movable between open and closed positions comprising a latch bolt assembly including a bolt movable between a partially extended latching position, a fully extended deadbolt position, and a retracted position, spring means biasing said bolt toward its deadbolt position, a spindle extending through said latch bolt assembly in a direction transverse of the direction of movement of said bolt, means connecting said spindle to said bolt for moving said bolt between its positions upon rotation of said spindle, means for normally biasing said bolt in its latching position including means for retaining said bolt in said latching position when said door is open and means effective in response to closing of said door from the position when said door is in the open position and said bolt is in said latching position for causing said bolt to be moved automatically into its deadbolt position when said door is moved into its closed position.

2. The lockset of claim 1 wherein said latch bolt assembly includes a casing having spaced side plates extending therefrom, a hub mounted for rotation in said side plates and including an opening through which said spindle extends, lever means extending from said hub, an arm pivotally attached to said bolt at one end and pivotally attached to said lever means at the other, said means for retaining said bolt in its latching position including means blocking said rotation of said hub into the deadbolt position of said bolt when the door is open.

3. The lockset of claim 2 further including unlocking means movable to an unlocking position to prevent said bolt from moving to said deadbolt position when the door is closed.

4. The lockset of claim 2 wherein said latch bolt assembly includes a pivot pin connecting said arm and said lever means and said side plates having a shoulder thereon for engagement by said pivot pin to hold said bolt in said latching position.

5. The lockset of claim 4 wherien said latch bolt assembly includes means to disengage said pivot pin from said shoulder upon closing of the door.

6. The lockset of claim 4 further including unlocking means movable to an unlocking position to prevent said bolt from moving into its dead bolt position when said door is closed.

7. The lockset assembly of claim 6 wherien said unlocking means includes a turn button.

8. The lockset of claim 4 further including an inside and outside lever, said outside lever operably connected to said spindle to move said bolt from its latching position to its open position and said inside lever operably connected to said spindle to move said bolt from its dead bolt position to its open position.

9. The lockset of claim 8 wherein said outside lever has a key operated cylinder therein and means interconnecting said cylinder and said spindle so that upon operation of said cylinder, said bolt is moved from its deadbolt position to its open position.

10. A latch assembly for use with a lockset comprising:

a casing having spaced side plates extending rearwardly therefrom;

a hub with a tail piece thereon mounted for rotation in said side plates and having lever means extending therefrom;

a bolt movable between an open, fully retracted position, a partially extended latching position, and a fully extended deadbolt position;

an arm pivotably attached at one end to said bolt and at the other end to said lever means; and spring means in engagement with said tail piece when said tail piece is in a first position for biasing said bolt forward in said deadbolt position and when said tail piece is in a second position for biasing said bolt to limit the forward movement of said bolt to said partially extended latching position while permitting movement of said bolt between said fully retracted position and said partially extended latching position.

11. A latch assembly for use with a lockset comprising:

a casing having spaced side plates extending rearwardly therefrom;

a hub with a tail piece thereon mounted for rotation in said side plates and having lever means extending therefrom;

a bolt movable between an open, fully retracted position, a partially extended latching position, and a fully extended deadbolt position;

an arm pivotably attached at one end to said bolt and at the other end to said lever means; and spring means mounted on said side plates for biasing said latch bolt forward when it is in said deadbolt and biasing it against movement into its open position when it is in said latching position and engaging said tail piece when said bolt is in said deadbolt and latching positions.

12. A lockset having unlocked and locked states for a door movable between open and closed positions comprising a latch bolt assembly including a bolt movable between a partially extended latching position, a fully extended deadbolt position, and a retracted position, spring means for biasing said bolt toward its latching position and its deadbolt position, a spindle extending through said latch bolt assembly in a direction transverse of the direction of movement of said bolt, a casing having spaced side plates extending therefrom, a hub mounted for rotation in said side plates and including an opening through which said spindle extends, lever means extending from said hub, an arm pivotally attached to said bolt at one end and pivotally attached to said lever means at the other, where upon rotation of said spindle said bolt is moved between its positions, a pivot pin connecting said arm and said lever means and said side plates having a shoulder thereon for engagement by said pivot pin to hold said bolt in said latching position when said door is open, a plunger having a forward portion extending forwardly from said case and a rearward portion extending along said side plates and having a cam surface thereon for engaging said pivot pin when said pivot pin is in engagement with said shoulder to lift said pivot pin over said shoulder effective in response to the closing of said door to permit said bolt to move into its deadbolt position when said plunger is moved rearwardly, and means biasing said plunger in a forward direction.

* * * * *